US011295655B2

(12) United States Patent
Ji et al.

(10) Patent No.: US 11,295,655 B2
(45) Date of Patent: Apr. 5, 2022

(54) TIMING CONTROL BOARD, DRIVE DEVICE AND DISPLAY DEVICE

(71) Applicants: CHONGQING HKC OPTOELECTRONICS TECHNOLOGY CO., LTD., Chongqing (CN); HKC CORPORATION LIMITED, Guangdong (CN)

(72) Inventors: Feilin Ji, Chongqing (CN); Lidan Ye, Chongqing (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/201,541

(22) Filed: Mar. 15, 2021

(65) Prior Publication Data

US 2022/0036786 A1 Feb. 3, 2022

(30) Foreign Application Priority Data

Jul. 28, 2020 (CN) ..... 202010741424.9

(51) Int. Cl.
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2310/08* (2013.01); *G09G 2370/00* (2013.01)

(58) Field of Classification Search
CPC ..... G09G 5/006; G09G 2300/0408; G09G 2320/0666; G09G 5/005; G09G 2300/0819; G09G 2300/0842; G09G 2300/0852; G09G 2310/08; G09G 2320/064
See application file for complete search history.

(56) References Cited

U.S. PATENT DOCUMENTS

2009/0327777 A1* 12/2009 Vasquez ..... G09G 3/36 713/320
2011/0276617 A1* 11/2011 Oksanen ..... H04H 60/44 709/201
2014/0359196 A1* 12/2014 Ragland ..... G06F 13/1689 711/102
2020/0135093 A1* 4/2020 Prathaban ..... G09G 3/32
2020/0326769 A1* 10/2020 Ansari ..... G06F 1/3218
2020/0327843 A1* 10/2020 Ahmed ..... G09G 3/2003
2021/0034115 A1* 2/2021 Pichumani ..... G06F 1/1656

* cited by examiner

*Primary Examiner* — Gerald Johnson

(57) ABSTRACT

A timing control board includes a point-to-point interface, a storage, a signal input port and a timing controller. The storage is for storing multiple sets of different point-to-point configuration parameters. The timing controller obtains a set of point-to-point configuration parameters matching a protocol type of a source drive circuit board in the storage according to the configuration parameter selection signal, and initializes settings according to the set of point-to-point configuration parameters to generate matched data signals and output the data signals to the source drive circuit board through the point-to-point interface, so as to realize the compatibility of display panels and reduce the design cost.

18 Claims, 3 Drawing Sheets

TIMING CONTROL BOARD, DRIVE DEVICE AND DISPLAY DEVICE

CROSS-REFERENCE TO RELATED APPLICATIONS

The present disclosure claims the benefit of a Chinese patent application no. 202010741424.9, filed on Jul. 28, 2020, entitled "Timing Control Board, Drive Device and Display Device", the entire content of which is incorporated herein for reference.

TECHNICAL FIELD

The present disclosure relates to the technical field of display panels, in particular to a timing control board, a drive device and a display device.

BACKGROUND

The statements herein only provide background information related to this disclosure and does not necessarily constitute prior art.

With the development of TV display panel technology, consumers have higher and higher requirements for display, and panels are also developing towards large size and high resolution. At present, UHD (Ultra High Definition) resolution has become the mainstream on the market. The mini-LVDS (Mini Low Voltage Differential Signaling) interface and point-to-point interface are commonly used between the timing control board and the source drive circuit board. Compared with the mini-LVDS interface, the point-to-point interface has higher transmission rate, higher transmission data capacity and stronger anti-electromagnetic interference capability, and represents a new development trend of interface technology.

At present, different point-to-point interface technology are applied by different manufacturers, and there is no unified protocol for the point-to-point interface technology. For example, Samsung uses USI-T (Unified Standard Interface) protocol type display panels, while other manufacturers use other protocol type display panels, such as ISP (In-System Programming) protocol, and etc. Therefore, for display panels supporting different protocol types, timing control boards need to be designed separately, resulting in increased design costs.

SUMMARY

The present disclosure provides a timing control board for a display panel, which includes:

a point-to-point interface for connecting a source drive circuit board and performing point-to-point signal transmission;

a storage for storing a plurality of different sets of point-to-point configuration parameters;

a signal input interface for receiving a configuration parameter selection signal; and a timing controller connected with the point-to-point interface, the signal input port and the storage, and for obtaining a set of point-to-point configuration parameters in the storage that matches a protocol type of the source drive circuit board according to the configuration parameter selection signal, and initializing settings according to the set of point-to-point configuration parameters, to generate matched data signals and clock signals and output the data signals and clock signals to the source driving circuit board through the point-to-point interface.

In an embodiment, the storage is provided with a plurality of storage areas, each of the plurality of storage areas is for storing a set of point-to-point configuration parameters different from sets of point-to-point configuration parameters stored in others of the plurality of storage areas.

In an embodiment, the signal input port includes a first common port for receiving the configuration parameter selection signal and a synchronization signal input port for receiving a synchronization drive signal for driving a display panel.

In an embodiment, the point-to-point interface includes a first signal interface and a second signal interface, the timing controller is for outputting the clock signals and the data signals through the first signal interface, and outputting a level synchronization signal through the second signal interface, the level synchronization signal is for identifying a level state for clock synchronization between the timing controller and the source drive circuit board in conjunction with the first signal interface.

In an embodiment, the storage is a flash memory or a read-only memory.

In an embodiment, the timing control board further includes a connector for connecting the point-to-point interface and the source drive circuit board.

In an embodiment, that connector is a flexible circuit board connector.

In an embodiment, the timing controller is connected with the storage through a serial peripheral interface, and is for outputting a chip selection signal to the storage through the serial peripheral interface to obtain the set of point-to-point configuration parameters in the storage that matches the protocol type of the source drive circuit board, after receiving the configuration parameter selection signal.

The present disclosure also provides a timing control board for a display panel, which includes:

a point-to-point interface for connecting a source drive circuit board and performing point-to-point signal transmission;

a storage provided with a plurality of storage areas, each of the plurality of storage areas being for storing a set of point-to-point configuration parameters different from sets of point-to-point configuration parameters stored in others of the plurality of storage areas;

a signal input interface for receiving a configuration parameter selection signal; and a timing controller connected with the point-to-point interface, the signal input port and the storage;

the timing controller is connected with the storage through a serial peripheral interface, and is for outputting a chip selection signal to the storage through the serial peripheral interface to obtain a set of point-to-point configuration parameters in the storage that matches the protocol type of the source drive circuit board, according to the configuration parameter selection signal, and initializing settings according to the set of point-to-point configuration parameters, to generate matched data signals and clock signals and output the data signals and clock signals to the source driving circuit board through the point-to-point interface.

The present disclosure also provides a drive device. The drive device includes a source drive circuit board, a gate drive circuit board and a timing control board as described above. The timing control board is connected with the source drive circuit board and the gate drive circuit board, the source drive circuit board and the gate drive circuit board are respectively connected with a data line and a scanning line of the display panel, and are respectively for outputting analog gray scale voltage signals and row scanning signals to drive the display panel.

The present disclosure further provides a display device including a display panel and the drive device as described above, a signal terminal of the display panel being connected to a signal terminal of the drive device.

Embodiments of the present disclosure adopts a point-to-point interface, a storage, a signal input interface and a timing controller to form a timing control board. The point-to-point interface is for connecting a source drive circuit board and performing point-to-point signal transmission. The storage stores multiple sets of different point-to-point configuration parameters. The signal input interface is for receiving a configuration parameter selection signal. The time controller obtains a set of point-to-point configuration parameters matching a protocol type of the source drive circuit board from the storage according to the configuration parameter selection signal, and initializes settings according to the set of point-to-point configuration parameters to generate matched data signals and clock signals and output the data signals and the clock signals to the source drive circuit board through the point-to-point interface, thereby realizing compatibility of the display panels and reduce the design cost.

BRIEF DESCRIPTION OF THE DRAWINGS

In order to more clearly illustrate the embodiments of the present disclosure, drawings used in the embodiments will be briefly described below. Obviously, the drawings in the following description are only some embodiments of the present disclosure. It will be apparent to those skilled in the art that other figures can be obtained according to the structures shown in the drawings without creative work.

The realization of purpose, functional features and advantages of the present disclosure will be further explained in connection with embodiments and with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. Besides, the meaning of "and/or" appearing in the disclosure includes three parallel scenarios. For example, "A and/or B" includes only A, or only B, or both A and B. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

The present disclosure provides a timing control board 100 for a display panel 300.

Figure 1:
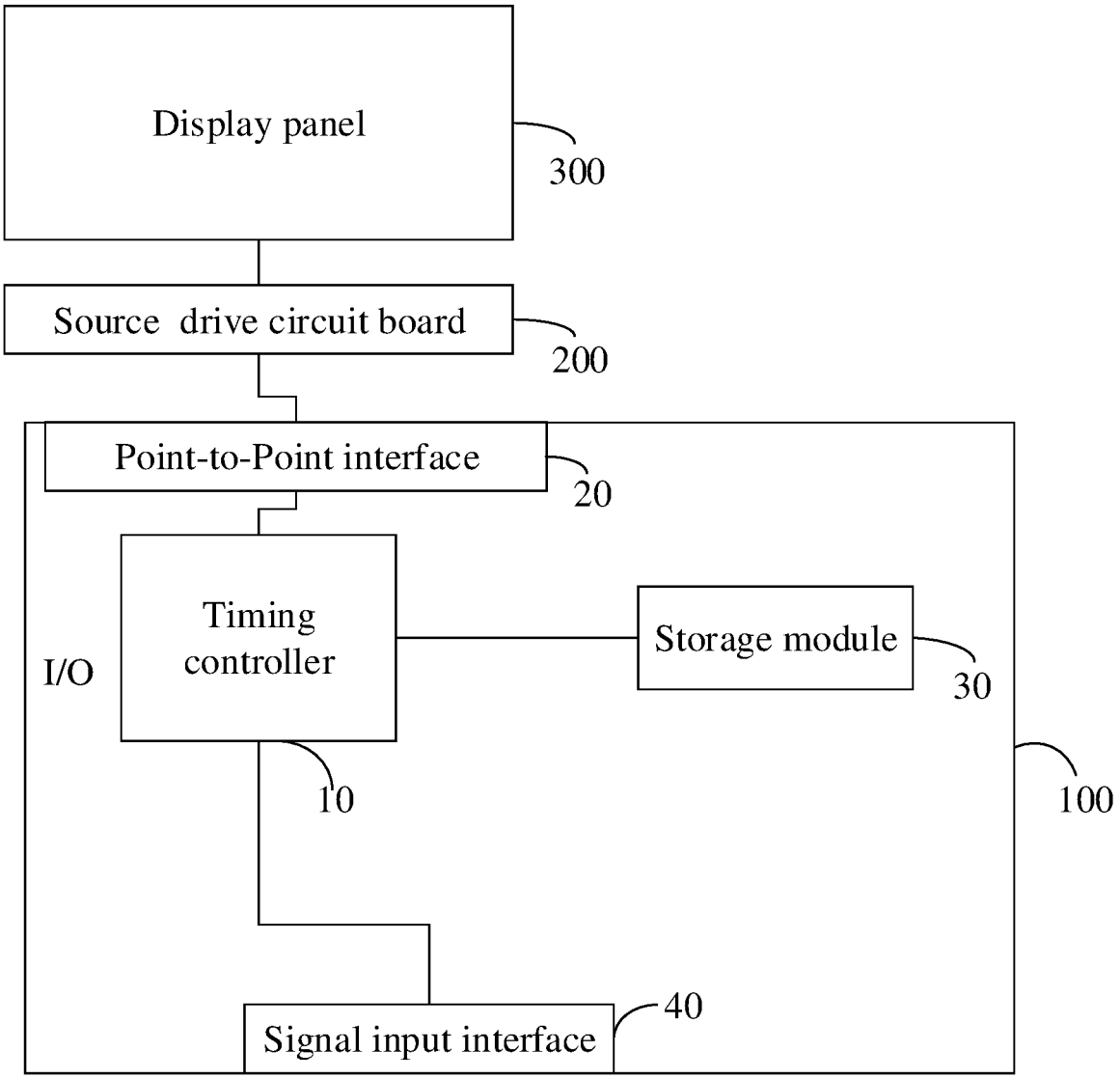
FIG. 1 is a block diagram of a first embodiment of a timing control board of the present disclosure.

As shown in FIG. 1, FIG. 1 is a block diagram of a first embodiment of the timing control board 100 of the present disclosure. In this embodiment, the timing control board 100 includes:

a point-to-point interface 20 for connecting a source drive circuit board 200 of the display panel 300 and performing point-to-point signal transmission;

a storage 30 for storing multiple different sets of point-to-point configuration parameters;

a signal input interface for receiving a configuration parameter selection signal; and a timing controller 10 connected with the point-to-point interface 20, the source drive circuit board 200 and the storage 30.

The time controller 10, is provided for obtaining a set of point-to-point configuration parameters in the storage 30 that matches a protocol type of the source drive circuit board 200 according to the configuration parameter selection signal, and initializing settings according to the set of point-to-point configuration parameters, to generate matched data signals and clock signals and output the data signals and clock signals to the source driving circuit board 200 through the point-to-point interface 20.

In this embodiment, the point-to-point interface 20, the storage 30, the signal input interface 40 and the timing controller 10 are all provided on a circuit board, and the timing control board 100 is also provided with a power management integrated circuit (not shown), a gamma circuit (not shown), a common electrode voltage circuit (not shown), etc. An input voltage at an input terminal of the power management integrated circuit is generally 5V or 12V, and output voltage of the power management integrated circuit includes a digital working voltage supplied to each Integrated Chip, analog voltages supplied to the gamma circuit and the common electrode voltage circuit, a gate turning on voltage and a gate turning off voltage supplied to a gate drive chip (G-IC).

The point-to-point interface 20 has higher transmission rate, higher transmission data capacity and stronger anti-electromagnetic interference capability than the mini-LVDS interface. When the point-to-point interface 20 is adopted, the timing controller 10 and a source drive circuit of the source drive circuit board 200 communicate through data pairs. The clock signals are embedded in the data signals, and each source drive chip transmit data using a pair of data pairs.

The storage 30 stores a plurality of sets of point-to-point configuration parameters of different protocol types. The sets of point-to-point configuration parameters can be written in advance or later, new sets of point-to-point configuration parameters can be added or old sets of point-to-point configuration parameters can be deleted as products are updated. As such, the storage 30 may be partitioned or chunked for point-to-point configuration parameter storage. In one embodiment, the storage 30 is provided with a plurality of storage areas, Each storage area is set to store a set of point-to-point configuration parameters different from sets of point-to-point configuration parameters stored in other storage area. A size of each storage area of the storage 30 can be set correspondingly. For example, it may assign a storage area of 2 M to store a set of point-to-point configuration parameters. When three sets of point-to-point configuration parameters need to be stored, a capacity of the storage 30 needs to be 6 M. It can be understood that the capacity of the storage 30 can be set according to the number of stored sets of point-to-point configuration parameters without specific restrictions.

The signal input interface 40 is also provided on the timing control board 100. The timing controller 10 is connected to a system main board of the display device through the signal input interface 40. The system main board is for driving the display panel 300 and a backlight to work. A type of the signal input interface 40 of the timing control board 100 can be a low voltage differential signal interface, an embedded display signal interface, or a transistor-transistor logic signal interface. In this embodiment, the type of the signal input interface 40 is not specifically limited.

For display panels 300 of different protocol types, protocols types supported by source drive circuit boards 200 matching with them are different, internal configurations and output signals of timing controllers 10 are also different. In order to obtain a timing controller 10 matching a display panel 300, after the timing control board 100 is connected to the source drive circuit board of the display panel 300, the signal input interface 40 receives the configuration parameter selection signal output by the system main board. The configuration parameter selection signal may be a binary code or other selection signal, for example the configuration parameter selection signal may be a binary code 001, 010, or 100. Different binary codes correspond to different sets of point-to-point configuration parameters. The timing controller 10 outputs a corresponding chip selection signal to the storage 30 according to the binary code, so as to obtain a corresponding set of point-to-point configuration parameters. The timing controller 10 performs self initialization and parameter setting such as power supply parameter configuration, data signal configuration, clock signal configuration, etc., according to the obtained set of point-to-point configuration parameters, and outputs clock signals and data signals matching the source drive circuit board 200.

In an alternative embodiment, the signal input interface 40 includes a first common port and a synchronization signal input port. The first common port is configured to receive a configuration parameter selection signal. The synchronization signal input port is configured to receive a synchronization drive signal for driving the display panel 300. The timing controller 10 is further configured to convert the synchronization drive signal into control drive signals required by the source drive circuit board 200 and the gate drive circuit board 500, the control drive signal including data signals and clock signals.

In this embodiment, the time control board 100 includes a point-to-point interface 20, a storage 30, a signal input interface 40 and a time control 10. The point-to-point interface 20 is connected with a source drive circuit board 200 and performs point-to-point signal transmission. The storage 30 stores a plurality of different sets of point-to-point configuration parameters. The signal input interface 40 receives a configuration parameter selection signal. The time controller 10 receives the configuration parameter selection signal, obtains a set of point-to-point configuration parameters from the storage 30 that matches the protocol type of the source drive circuit board 200 according to the configuration parameter selection signal, performs initialization settings according to the point-to-point configuration parameters, to generate matched data signals and clock signals and output the data signals and the clock signals to the source drive circuit board 200 through the point-to-point interface 20, thereby realizing compatibility of display panels 300 and reducing design cost.

In an alternative embodiment, the storage 30 is provided with a plurality of storage areas, each of which is for storing a set of point-to-point configuration parameters which is different from other sets of point-to-point configuration parameters stored in other storage areas.

Generally, the storage 30 that can be used in this embodiment has block and sector designs, which can be read and written by block and sector. One sector is 4K bytes, and one block has sixteen sectors and 64 K bytes. When a 2 M flash memory is used, the flash memory has four blocks with storage addresses of 000000H to 03FFFFH. When a 4 M flash memory is used, the flash memory has eight blocks with storage addresses of 000000H to 07FFFFH. Assuming that storage 30 stores two types of point-to-point configuration parameters, such as USI-T and ISP, the first four blocks can be assigned to store the configuration parameters of USI-T with storage addresses from 000000H to 03FFFFH, the last four blocks can be assigned to store the configuration parameters of ISP with storage addresses from 040000H to 07FFFFH. It can be understood that when a plurality of sets of point-to-point configuration parameters are stored, the storage 30 can be correspondingly partitioned, such as can be partitioned in blocks or sectors to store the plurality of sets of point-to-point configuration parameters.

In still an alternative embodiment, the point-to-point interface 20 includes a first signal interface and a second signal interface. The timing controller 10 outputs clock signals and data signals through the first signal interface, and outputs level synchronization signals through the second signal interface. The level synchronization signals is for identifying level states for clock synchronization between the timing controller 10 and the source drive circuit board 200 in conjunction with the first signal port.

Specifically, during panel driving, the point-to-point high-speed signal transmission technology is used to carry out signal transmission, It is characterized in that a one-to-one correspondence relationship between first signal interfaces of two chips (e.g., the timing controller 10 and the source drive chip) of a panel drive circuit is established, so as to transmit high-speed differential data signals therebetween. Usually, clock signals are embedded in data signals, and the source drive chip restores the clock signals according to characteristics of received signals. The timing controller 10 is further provided with an additional second signal interface. A plurality of source drive chips are connected in parallel and connected to the second signal interface. The second signal interface is for identifying the level states for clock synchronization between the timing controller 10 and the source drive chips in cooperation with the first signal interface.

In still an alternative embodiment, the storage 30 is a flash memory or a read-only memory.

In this embodiment, the flash memory is a non-volatile memory, and data in the flash memory can be maintained for a long time without current supply. The flash memory has the storage characteristics equivalent to that of a hard disk. Different storage areas of the flash memory store different sets of point-to-point configuration parameters and are connected with the timing controller 10 through a serial peripheral interface for data transmission. The flash memory can be provided with multiple pins to connect with the timing controller 10, including input and output pins, chip selection signal pins, etc.

The read-only memory is a solid semiconductor memory and data pre-stored in the read-only memory can be read only and cannot be changed or deleted. Read-only memories are usually used in electronic or computer systems that do not need to change data frequently, and the data will not disappear due to turning off of power supply. The read-only memories have simple structures and the data in them are convenient to be read, thus, the read-only memories are often used to store various fixed programs and data.

In the embodiment, the flash memory or the read-only memory can be selected to be used in the timing control board 100 according to requirements.

Further, in an embodiment, the storage 30 is a flash memory, and point-to-point configuration parameters in the flash memory can be written and erased.

To further improve the compatibility of the timing control board 100, the point-to-point configuration parameters stored in the flash memory can be written and erased to adapt to more types of source drive circuit boards 200. The point-to-point configuration parameters can be burned to the flash memory via a reserved burning port of the flash memory or through an input port of the timing control board 100. A specific burning mode can be selected according to requirements, without specific restrictions.

Figure 2:
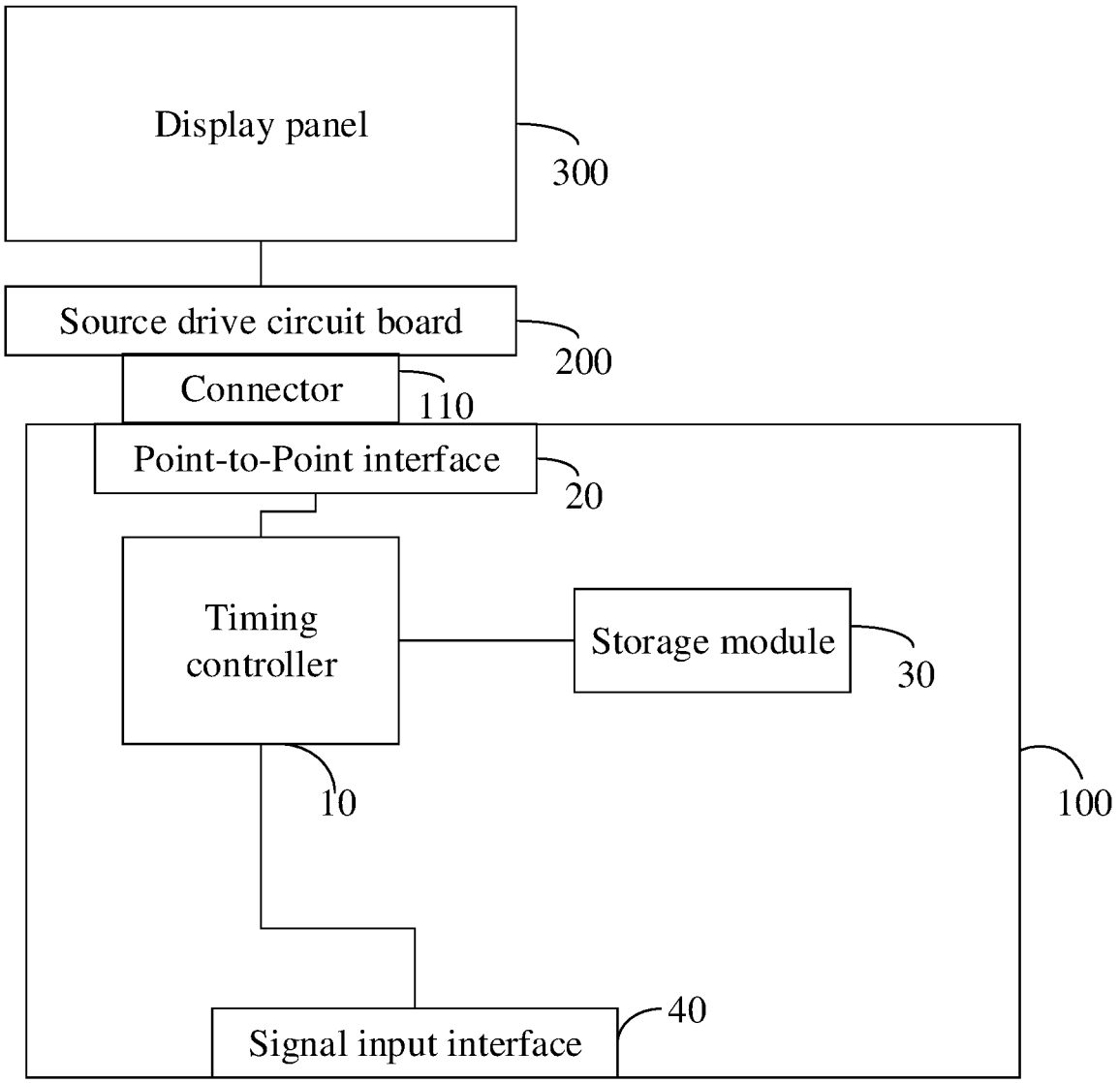
FIG. 2 is a block diagram of a second embodiment of the timing control board of the present disclosure.

As shown in FIG. 2, FIG. 2 is a block diagram of a second embodiment of the timing control board 100 of the present disclosure. In order to ensure a stable connection between the timing control board 100 and the source drive circuit board 200, In this embodiment, the timing control board 100 further includes a connector 110 to connect the point-to-point interface 20 and the source drive circuit board 200. The connector 110 can use a flexible circuit board (PFC) connector to enable the timing control board 100 to connect with different types of source drive circuit boards 200, so as to ensure consistent pin sequence of power supply signals and control signals. For example, a pull-out PFC connector or a front-lid PFC connector can be used. A specific structure of the PFC connector can be selected according to an actual situation and is not specifically limited herein.

Figure 3:
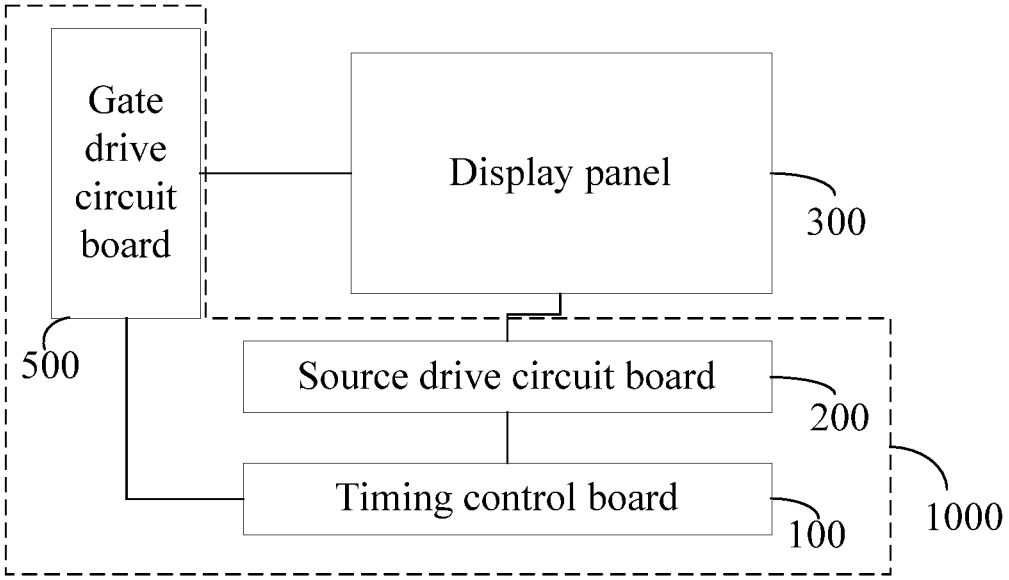
FIG. 3 is a block diagram of an embodiment of a drive device of the present disclosure.

As shown in FIG. 3, FIG. 3 is a block diagram of an embodiment of a drive device of the present disclosure. The present disclosure provides a drive device 1000. the drive device 1000 includes a source drive circuit board 200, a gate drive circuit board 500 and a timing control board 100. The specific structure of the timing control board 100 refers to the above-mentioned embodiments. Since the drive device 1000 of the present disclosure adopts all the technical solutions of all the above-mentioned embodiments, it has at least all the beneficial effects brought by the technical solutions of the above-mentioned embodiments, which will not be repeated here. The timing control board 100 is connected to the source drive circuit board 200 and the gate drive circuit board 500, respectively. The source drive circuit board 200 and the gate drive circuit board 500 are connected to data lines and scan lines of the display panel 300, respectively, and output analog gray-scale voltage signals and row scan signals to drive the display panel 300, respectively.

In this embodiment, the gate drive circuit board 500 may be directly connected to the timing control board 100, or through the connector 110. A specific connection mode between the gate drive circuit board 500 and the timing control board 100 is designed according to an actual structure of the display panel 300 without specific restrictions. The source drive circuit board 200 and the gate drive circuit board 500 receive the control signals output by the timing control board 100, and correspondingly output analog voltage signals and row scanning signals of different voltage levels to drive the display panel 300 to work.

The present disclosure further provides a display device. The display device includes a drive device 1000 and a display panel 300. A specific structure of the drive device refers to the above-mentioned embodiments. Since the display device adopts all the technical solutions of the above-mentioned embodiments, it has at least all the beneficial effects brought by the technical solutions of the above-mentioned embodiments, which will not be repeated here.

The foregoing are only alternative embodiments of the present disclosure and are not thus limiting the claimed scope of the present disclosure. Any equivalent structural transformation made by utilizing the contents of the specification and the accompanying drawings of the present disclosure, or direct/indirect application in other related technical fields, is included in the claimed scope of the present disclosure.

What is claimed is:

1. A timing control board, comprising:

a point-to-point interface for connecting a source drive circuit board and performing point-to-point signal transmission;

a storage for storing a plurality of different sets of point-to-point configuration parameters;

a signal input interface for receiving a configuration parameter selection signal; and a timing controller connected with the point-to-point interface, the signal input port and the storage, wherein the timing controller is for:

obtaining a set of point-to-point configuration parameters in the storage that matches a protocol type of the source drive circuit board according to the configuration parameter selection signal, initializing settings according to the set of point-to-point configuration parameters, to generate matched data signals and clock signals, and outputting the data signals and clock signals to the source driving circuit board through the point-to-point interface.

2. The timing control board of claim 1, wherein the storage is provided with a plurality of storage areas, each of the plurality of storage areas is for storing a set of point-to-point configuration parameters different from sets of point-to-point configuration parameters stored in others of the plurality of storage areas.

3. The timing control board of claim 1, wherein the signal input port comprises a first common port for receiving the configuration parameter selection signal, and a synchronization signal input port for receiving a synchronization drive signal for driving a display panel.

4. The timing control board of claim 3, wherein, the point-to-point interface comprises a first signal interface and a second signal interface, the timing controller is for outputting the clock signals and the data signals through the first signal interface, and outputting a level synchronization signal through the second signal interface, the level synchronization signal is for identifying a level state for clock synchronization between the timing controller and the source drive circuit board in conjunction with the first signal interface.

5. The timing control board of claim 1, wherein the storage is a flash memory or a read-only memory.

6. The timing control board of claim 1, further comprising a connector for connecting the point-to-point interface and the source drive circuit board.

7. The timing control board of claim 6, wherein the connector is a flexible circuit board connector.

8. The timing control board of claim 1, wherein, the timing controller is connected with the storage through a serial peripheral interface, and the timing controller is for outputting a chip selection signal to the storage through the serial peripheral interface to obtain the set of point-to-point configuration parameters in the storage that matches the protocol type of the source drive circuit board, after receiving the configuration parameter selection signal.

9. A timing control board, comprising:

a point-to-point interface for connecting a source drive circuit board and performing point-to-point signal transmission;

a storage provided with a plurality of storage areas, each of the plurality of storage areas being for storing a set of point-to-point configuration parameters different from sets of point-to-point configuration parameters stored in others of the plurality of storage areas;

a signal input interface for receiving a configuration parameter selection signal; and a timing controller connected with the point-to-point interface, the signal input port and the storage;

wherein the timing controller is connected with the storage through a serial peripheral interface, and the timing controller is for:

outputting a chip selection signal to the storage through the serial peripheral interface, to obtain a set of point-to-point configuration parameters in the storage that matches the protocol type of the source drive circuit board, according to the configuration parameter selection signal, initializing settings according to the set of point-to-point configuration parameters, to generate matched data signals and clock signals, and outputting the data signals and clock signals to the source driving circuit board through the point-to-point interface.

10. A drive device, comprising:

a source drive circuit board connected with a data line a scanning line of a display panel and for outputting analog gray scale voltage signals to drive the display panel;

a gate drive circuit board connected with a scanning line of the display panel and for outputting row scanning signals to drive the display panel; and a timing control board of claim 1 connected with the source drive circuit board and the gate drive circuit board.

11. The drive device of claim 10, wherein the storage is provided with a plurality of storage areas, each of the plurality of storage areas is for storing a set of point-to-point configuration parameters different from sets of point-to-point configuration parameters stored in others of the plurality of storage areas.

12. The drive device of claim 10, wherein the signal input port comprises a first common port for receiving the configuration parameter selection signal, and a synchronization signal input port for receiving a synchronization drive signal for driving a display panel.

13. The drive device of claim 12, wherein, the point-to-point interface comprises a first signal interface and a second signal interface, the timing controller is for outputting the clock signals and the data signals through the first signal interface, and outputting a level synchronization signal through the second signal interface, the level synchronization signal is for identifying a level state for clock synchronization between the timing controller and the source drive circuit board in conjunction with the first signal interface.

14. The drive device of claim 10, wherein the storage is a flash memory or a read-only memory.

15. The drive device of claim 10, further comprising a connector for connecting the point-to-point interface and the source drive circuit board.

16. The drive device of claim 15, wherein the connector is a flexible circuit board connector.

17. The drive device of claim 10, wherein, the timing controller is connected with the storage through a serial peripheral interface, and the timing controller is for outputting a chip selection signal to the storage through the serial peripheral interface, to obtain the set of point-to-point configuration parameters in the storage that matches the protocol type of the source drive circuit board, after receiving the configuration parameter selection signal.

18. A display device comprising a display panel and a drive device of claim 9, wherein a signal terminal of the display panel is connected to a signal terminal of the drive device.

* * * * *